United States Patent [19]

Lee

[11] 4,145,602

[45] Mar. 20, 1979

[54] SKI BOOT AND GLOVE WARMER

[76] Inventor: Richard D. Lee, 24891 Woodside La., El Toro, Calif. 92630

[21] Appl. No.: 850,063

[22] Filed: Nov. 9, 1977

[51] Int. Cl.[2] ..... F26B 23/10

[52] U.S. Cl. ..... 219/370; 34/104; 34/239; 211/34; 211/35; 219/215; 219/521

[58] Field of Search ..... 219/370, 215, 521, 523, 219/529, 371, 374, 376, 380–382, 369; 34/103, 104, 239, 243; 223/51, 70, 73, 76; 211/34, 35, 37, 38

[56] References Cited

U.S. PATENT DOCUMENTS

| | | | |
|---|---|---|---|
| 314,460 | 3/1885 | Meredith | 34/104 |
| 2,189,366 | 2/1940 | Montague | 34/103 |
| 2,443,695 | 6/1948 | Russel | 219/369 |
| 3,154,392 | 10/1964 | Littman | 34/104 |
| 3,645,009 | 2/1972 | Ketchum | 34/104 |
| 3,730,354 | 5/1973 | Bronstein | 211/38 |
| 3,798,788 | 3/1974 | Kuntz | 34/239 |

*Primary Examiner*—Bruce A. Reynolds
*Assistant Examiner*—Bernard Roskoski
*Attorney, Agent, or Firm*—Fulwider, Patton, Rieber, Lee & Utecht

[57] ABSTRACT

There is disclosed a ski boot and glove warmer including a vertically extending blower body having a pair of spaced apart dryer tubes projecting horizontally from the front face thereof and each having a boot support bail spaced there below for supporting the back of a boot with the tubes projecting into the ankle portion thereof to direct hot air into the foot area of the boot. A pair of guides are positioned on opposite sides of the respective tubes for retaining the boots with the toes thereof directed upwardly from the support. An electric blower directs air over a heating element and into the tubes and is controlled by a coin actuated mechanism to operate for a predetermined period of time after insertion of a coin.

9 Claims, 9 Drawing Figures

FIG. 1
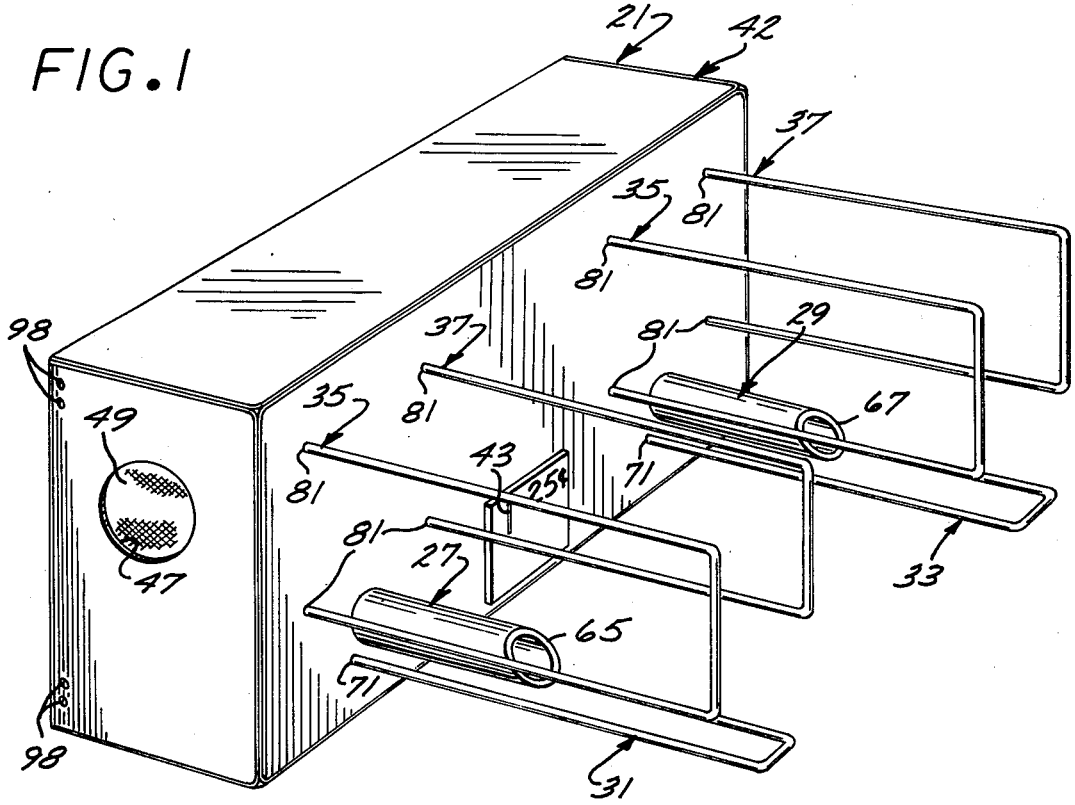
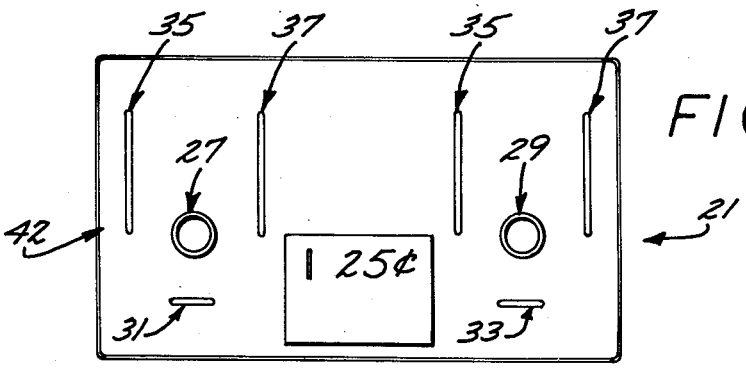
FIG. 2
FIG. 3
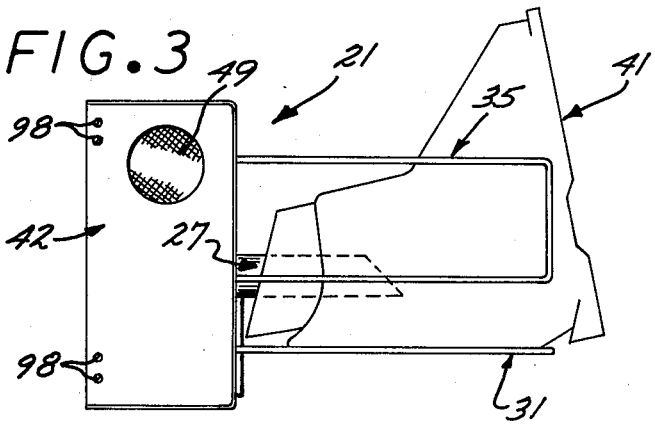
FIG. 4
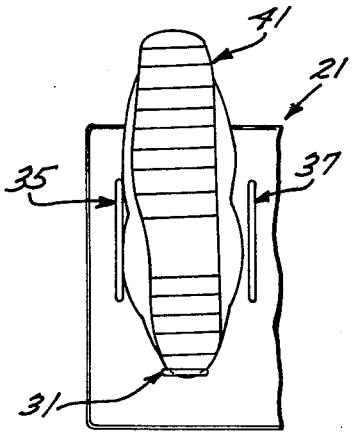

FIG.5
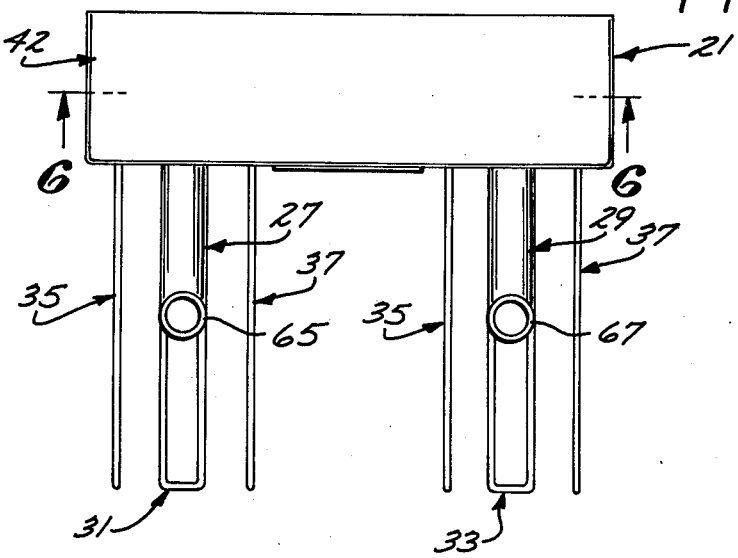
FIG.9
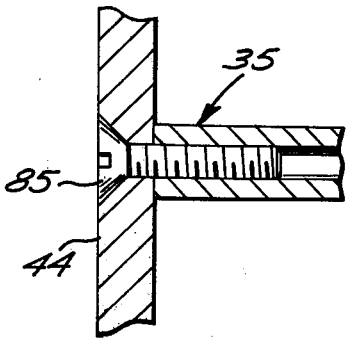
FIG.6
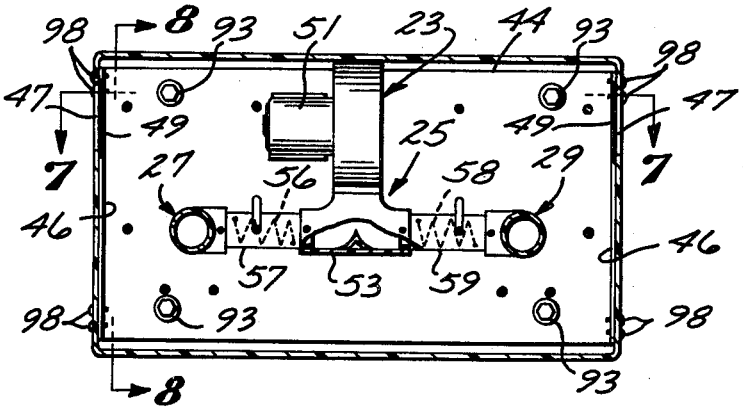
FIG.8
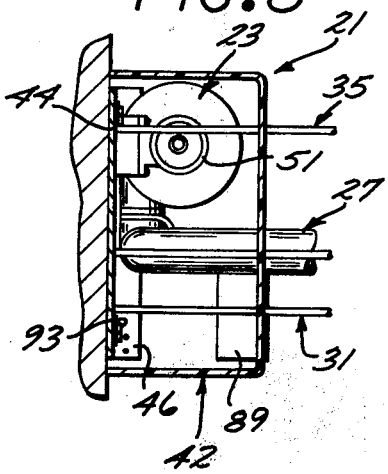
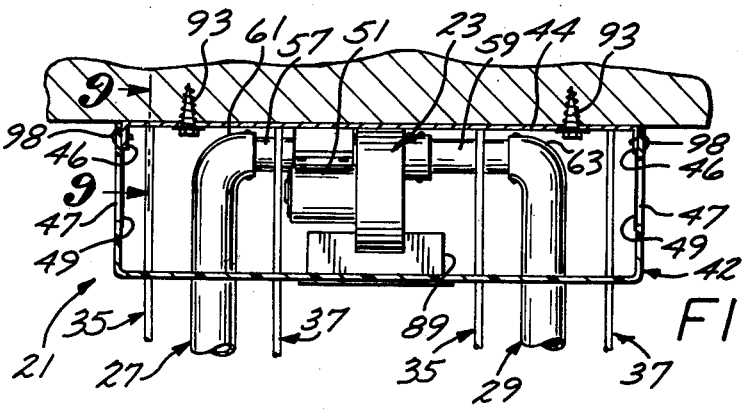
FIG.7

SKI BOOT AND GLOVE WARMER

BACKGROUND OF THE INVENTION

1. Field of the Invention

The ski boot and glove warmer of the present invention relates to apparatus for receiving and supporting a skier's boot while heated air is simultaneously directed into each of the boots for drying and heating of same and which may also be used to dry gloves.

2. Description of the Prior Art

Numerous different blowing and drying devices have been proposed for the drying of footwear on individual and group basis. Many of such devices provide nozzles for receipt of the footwear thereover and also serve to support the footwear itself. Other of such dryers provide flexible tubing having nozzles on the free extremity thereof for insertion in the footwear. However, there is no ski boot warmer known to applicant which supports the boot with the toe in its upright position and with a dryer nozzle inserted within the boot and automatically operable upon actuation of a coin operated mechanism to direct drying air into the boot for a predetermined period of time.

SUMMARY OF THE INVENTION

The ski boot and glove warmer of the present invention is characterized by a body having dryer tubes projecting horizontally therefrom and terminating in dryer nozzles received in the ankle of ski boots by resting on supports disposed beneath the nozzles and also including guides disposed on opposite sides of such supports. An air blower is provided for forcing air through a duct having a heater element therein and such blower and heater element are controlled by a coin actuated control mechanism.

These and other features of the invention will become apparent when taken in conjunction with the following detailed description of the drawings.

DESCRIPTION OF THE DRAWINGS

FIG. 1 is a perspective view of a glove and ski boot warmer embodying the present invention;

FIG. 2 is front view, in reduced scale, of the warmer shown in FIG. 1;

FIG. 3 is a side view of the warmer shown in FIG. 2 with a boot being warmed thereby;

FIG. 4 is a partial front view of the warmer shown in FIG. 2 with a boot being warmed thereby;

FIG. 5 is a top plan view of the ski boot warmer shown in FIG. 2;

FIG. 6 is a vertical sectional view, taken along the line 6—6 of FIG. 5;

FIG. 7 is a longitudinal sectional view, taken along the line 7—7 of FIG. 6;

FIG. 8 is a transverse sectional view taken along the line 8—8 of FIG. 6; and FIG. 9 is a detailed sectional view, in enlarged scale, taken along the line 9—9 of FIG. 7.

DESCRIPTION OF THE PREFERRED EMBODIMENT

Referring to FIGS. 1 and 6, the ski boot and glove warmer of the present invention includes, generally, a rectangular shaped dryer body 21 mounting therein an electric motor driven blower 23 (FIG. 6) which forces air through a bifurcated conduit 25 for exhausting through a pair of horizontally spaced apart dryer tubes 27 and 29. Mounted from the body 21 and spaced directly below each of the tubes 27 and 29 are respective boot support bails, generally designated 31 and 33, for receipt on the back of a boot positioned thereon. Disposed on opposite sides of the respective tubes 27 and 29 are respective pairs of guide rails, generally designated 35 and 37, which serve to support a boot 41 therebetween (FIG. 4). Consequently, a pair of boots 41 may be fitted over the dryer tubes 29 to rest on the support bails 31 and 33 and be held with the toe in the upright position as shown in FIG. 41 by means of the guide rails 35 and 37 while a coin is inserted in a coin slot 43 in the front of the body 21 (FIG. 1) to actuate the blower 23 (FIG. 6) to force heated air into the boots 41.

The warmer body 21 may be constructed of any desirable material, such as fiberglas and includes a back wall in the form of a mounting plate 44 (FIG. 7) which is formed on its opposite ends with outwardly turned marginal flanges 46 that fit within the end walls of a hollow rectangular cover 42. Such cover 42 is formed in its opposite ends with air intakes 47 (FIG. 1) covered by a mesh 49.

Referring to FIG. 7, the blower 23 is mounted on the back wall of the body 21 and has an electric drive motor 51 mounted on one side thereof for driving the blower fan (not shown). The fan 51 exhausts into a tee fitting 53 (FIG. 6) which has a pair of short conduits 57 and 59 inserted into the opposite ends thereof, elbows 61 and 63 formed in one end of the dryer tubes 27 and 29 being telescoped over the opposite ends of such conduits (FIG. 7). The tubes 27 and 29 then curve to project forwardly through bores formed in the front wall of the cover 42 and terminate at their outer extremities in upwardly and outwardly facing openings formed by camfered ends 65 and 67 (FIG. 1).

Referring to FIGS. 1 and 5, the support bails 31 and 33 are in the form of hollow tubes which are bent into a rectangular form disposed in a horizontal plane and are formed with opposite legs which project rearwardly beneath opposite sides of the respective drying tubes 27 and 29 to project through respective bores 71 formed in the front wall of the cover 42 and then project rearwardly as shown in FIG. 8, to be mounted from the mounting plate 44 by means of self threading screws which screw thereinto to firmly secure such supports in position.

The guide rails 35 and 37 are also in the form of hollow tubes, each of which is bent in the form of a rectangular hoop and lies generally in a vertical plane. The opposite legs of the rails 35 and 37 project through bores 81 formed in the front wall of the cover 42 and project rearwardly from such cover as shown in FIGS. 7 and 8, to be secured on their rear extremities to the mounting plate 44 by means of mounting screws 85 (FIG. 9).

Referring to FIG. 7, a coin box 89 is mounted from the front wall of the cover 42 and is formed in its front wall with the coin slot 43 (FIG. 1) and incorporates therein a coin actuated switch connected in series with the blower drive motor 51 and with the respective heating elements 56 and 58 mounted in the heating conduits 57 and 59 and is responsive to insertion of a quarter to close the circuit to such drive motor and heating elements for the predetermined period, such as two minutes.

When the ski boot and glove warmer of the present invention is to be installed, the cover is positioned over the mounting plate 44 with the dryer tubes 27 and 29 projecting through their respective bores and the opposite loop of the support bails 31 and 33 and guide rails 35 and 37 inserted through the front wall of such cover. The screws 85 mounting such bails 31, 33 and rails 35 and 37 are then inserted through the mounting plate 44 and screwed into the open ends of the legs of such support bails and guide rails. When the warmer is to be installed on the wall of a ski lodge or the like, the cover 42 may be slid outwardly along the legs of the support bails 31 and 33 and guide rails 35 and 37 and mounting screws 93 (FIGS. 6 and 7) inserted through bores in the mounting plate 44 to secure such plate to the wall of the lodge. The cover may then be slid rearwardly along the legs of the support bails 31 and 33 and guide rails 35 and 37 to fit the opposite walls thereof over the mounting plate flanges 46 and cover screws 98 inserted. The warmer is then ready for operation by the customer.

When a customer then elects to warm his boots, such as during lunch hour or the like, he can remove his boots from his feet and telescope the ankles thereof over the dryer tubes 27 and 29 as shown in FIG. 3, and the back of the boot rested on the support bail 31 or 33. The boot 41 will then be held with the toe in its upright position by means of the guide rails 35 and 37. The customer need then merely insert a coin in the slot 43 to actuate the coin control switch to close the circuit to the heating elements 57 and 59 and blower drive motor 51 to cause the blower to blow air through the heater conduits 57 and 59, and out the tubes 27 and 29. The air exhausting out the canted nozzles 65 and 67 will be directed axially outwardly and laterally upwardly and will flow against the interior of the heel of the boot and be deflected upwardly into the toe to be circulated back out through the ankle of the boot. Such circulation through the boot provides for rapid heating thereof and carrying of moisture from the boot to thus rapidly dry and warm the boot. After a predetermined period, such as two minutes, the blower drive motor 51 and heating elements 57 and 59 will be automatically de-energized and the boots 41 may be removed from the respective support bails 31 and 33 and replaced on the skier's feet to warm his feet prior to returning to the ski slope. If the skier also desires to warm his gloves, he can remove the boots 41 during the last portion of the drying cycle, telescope the wrists of his gloves over the tubes 27 and 29 to direct heated dry air into the fingers thereof.

From the foregoing, it will be appreciated that the ski boot and glove warmer of the present invention provides an economical and convenient means for rapidly and efficiently drying and warming a ski boot and for automatically shutting off when the drying operation has been completed.

Various modifications and changes may be made with regard to the foregoing detailed description without departing from the spirit of the invention.

I claim:

1. A ski boot and glove warmer comprising:

a vertically extending body;

a pair of horizontal transversely spaced apart air tubes mounted on said body and projecting parallelly in one direction therefrom to terminate in hot air nozzles;

a pair of boot supports projecting horizontally from said body beneath said respective tubes for receiving the backs of six boots thereon when said boots are positioned with said tubes inserted in said boots;

two pairs of guide rails disposed on respective opposite sides of said tubes, above said respective supports, for receipt therebetween of said boots to hold said boots with the toes projecting upwardly;

blower means mounted in said body and including an electric drive motor;

duct means leading from said blower means to said respective tubes;

electric heater means in said duct means for heating air directed to said ducts; and coin actuated control means connected with said electric drive motor and heater means and including means responsive to insertion of a preselected denomination of currency to render said electric motor and heater operative for a predetermined period of time whereby a pair of cold or damp ski boots may be telescoped over said tubes positioned on said supports and held with the toes up by said guide rails and said predetermined denomination of currency inserted to blow air over said heater means to be heated and exhausted into said support boots.

2. A ski boot and glove warmer as set forth in Claim 1 wherein:

said body includes a mounting plate defining the back wall thereof, a hollow cover fitted thereover and wherein said support and guide rails are mounted from said back wall and project through said cover.

3. A ski boot and glove warmer as set forth in claim 1 wherein:

said supports are in the form of horizontally disposed rectangularly shaped bails for nesting of the backs of ski boots between the opposite legs thereof.

4. A ski boot and glove warmer as set forth in claim 1 wherein:

said guide rails are in the form of vertically disposed rectangular hoops.

5. A ski boot and glove warmer as set forth in claim 1 wherein:

said tubes terminate at their outer extremities in outwardly and downwardly sloping chamfers forming outwardly and upwardly facing openings defining said nozzles.

6. A ski boot and glove warmer as set forth in claim 1 wherein:

said blower means includes a housing formed with an exhaust tee having oppositely directed legs;

said duct means includes respective conduits telescoped on their respective one ends into said legs and connected on their respective opposite ends with said respective tubes; and said heater means includes heating elements disposed in said respective conduits.

7. A ski boot and glove warmer as set forth in claim 2 wherein:

said blower means includes a blower housing mounted on said back wall and including an exhaust tee having oppositely projecting legs; and said duct means includes conduits telescoped on their respective one ends into said legs and connected on their respective opposite ends and with said tubes.

8. A ski boot and glove warmer as set forth in claim 2 wherein:

said supports are in the form of horizontally disposed rectangularly shaped bails for nesting of the backs of ski boots between the opposite legs thereof.

9. A ski boot and glove warmer as set forth in claim 2 wherein:

said supports are in the form of horizontally disposed rectangularly shaped bails for nesting of the backs of ski boots between the opposite legs thereof; and said guide rails are in the form of vertically disposed rectangular hoops.

* * * * *